US010975507B2

(12) United States Patent
Kawaguchi et al.

(10) Patent No.: US 10,975,507 B2
(45) Date of Patent: Apr. 13, 2021

(54) EMBROIDERY FRAME, EMBROIDERY FRAME UNIT, AND SEWING MACHINE

(71) Applicant: BROTHER KOGYO KABUSHIKI KAISHA, Nagoya (JP)

(72) Inventors: Yasuhiko Kawaguchi, Nagoya (JP); Daisuke Ueda, Seto (JP); Mitsuhiro Iida, Gifu (JP); Takahira Osamura, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 385 days.

(21) Appl. No.: 16/038,661

(22) Filed: Jul. 18, 2018

(65) Prior Publication Data

US 2018/0320300 A1 Nov. 8, 2018

Related U.S. Application Data

(63) Continuation-in-part of application No. PCT/JP2017/001893, filed on Jan. 20, 2017.

(30) Foreign Application Priority Data

Feb. 26, 2016 (JP) ..... JP2016-035445

(51) Int. Cl.
*D05C 9/04* (2006.01)
*D05B 39/00* (2006.01)

(52) U.S. Cl.
CPC ..... *D05C 9/04* (2013.01); *D05B 39/00* (2013.01)

(58) Field of Classification Search
CPC ..... D05C 9/04; D05C 1/02; D05B 39/00
See application file for complete search history.

(56) References Cited

U.S. PATENT DOCUMENTS 6,336,416 B1 * 1/2002 French ..... D05C 9/04 112/103
2006/0180066 A1 * 8/2006 Okazaki ..... D05C 9/04 112/258

(Continued)

FOREIGN PATENT DOCUMENTS

JP H06-081473 U 11/1994
JP 2005-334250 A 12/2005

(Continued)

OTHER PUBLICATIONS

Sep. 24, 2019 Japanese Office Action issued in Japanese Patent Application No. 2016-035445.

(Continued)

*Primary Examiner* — Tajash D Patel
(74) *Attorney, Agent, or Firm* — Oliff PLC

(57) ABSTRACT

An embroidery frame includes a pair of a first frame and a second frame configured to clamp a sewing object, and a lock mechanism. The lock mechanism is configured to switch a position of the second frame with respect to the first frame to at least three positions including a first position, a second position and a third position. The first position is a position in which the second frame is closed with respect to the first frame. The second position is a position in which, with respect to the first frame, the second frame is more open, by a first predetermined amount, than in the first position. The third position is a position in which, with respect to the first frame, the second frame is open by a second predetermined amount. The second predetermined amount is larger than the first predetermined amount.

10 Claims, 8 Drawing Sheets

(56) References Cited

U.S. PATENT DOCUMENTS

| | | | | |
|---|---|---|---|---|
| 2007/0079741 | A1 | 4/2007 | Watanabe et al. | |
| 2007/0277715 | A1 | 12/2007 | Watanabe | |
| 2013/0074751 | A1* | 3/2013 | Magara ..... | D05C 9/04<br>112/103 |

FOREIGN PATENT DOCUMENTS

| | | | |
|---|---|---|---|
| JP | 2007-105138 | A | 4/2007 |
| JP | 2007-319509 | A | 12/2007 |
| JP | 2015-048538 | A | 3/2015 |

OTHER PUBLICATIONS

Apr. 25, 2017 International Search Report issued in Patent Application No. PCT/JP2017/001893.

Apr. 25, 2017 Written Opinion of the International Searching Authority issued in International Patent Application No. PCT/JP2017/001893.

* cited by examiner

EMBROIDERY FRAME, EMBROIDERY FRAME UNIT, AND SEWING MACHINE

CROSS-REFERENCE TO RELATED APPLICATION

This application is a continuation-in-part of International Application No. PCT/JP2017/001893, filed Jan. 20, 2017, which claims priority from Japanese Patent Application No. 2016-035445, filed on Feb. 26, 2016. The disclosure of the foregoing application is hereby incorporated by reference in its entirety.

BACKGROUND

The present disclosure relates to an embroidery frame that is configured be mounted on a sewing machine, an embroidery frame unit, and a sewing machine.

An embroidery frame is known that is used by being mounted on a sewing machine capable of embroidery sewing. The embroidery frame provided with an upper frame and a lower fame can be mounted on the known sewing machine. The upper frame of the embroidery frame is coupled to the lower frame using a coupling member, such that the upper frame can swing up and down.

SUMMARY

With the known embroidery frame, there is a case in which a sewing object cannot be caused to be held appropriately by the embroidery frame.

Various embodiments of the broad principles derived herein provide an embroidery frame, an embroidery frame unit, and a sewing machine that are capable of appropriately causing a sewing object to be held by the embroidery frame, in comparison to related art.

Embodiments provide an embroidery frame that includes a pair of a first frame and a second frame, and a lock mechanism. The pair of a first frame and a second frame is configured to clamp a sewing object. The lock mechanism is configured to switch a position of the second frame with respect to the first frame to at least three positions including a first position, a second position and a third position. The first position is a position in which the second frame is closed with respect to the first frame. The second position is a position in which, with respect to the first frame, the second frame is more open, by a first predetermined amount, than in the first position. The third position is a position in which, with respect to the first frame, the second frame is open by a second predetermined amount. The second predetermined amount is larger than the first predetermined amount.

Embodiments also provide an embroidery frame unit that includes a frame attachment member and an embroidery frame. The frame attachment member includes an attachment portion and a frame support portion removably fixed to a holder of a movement mechanism of a sewing machine. The embroidery frame includes a pair of a first frame and a second frame, and a lock mechanism. The embroidery frame is removably held by the attachment portion. The pair of the first frame and the second frame is configured to clamp a sewing object. The lock mechanism is configured to switch a position of the second frame with respect to the first frame to at least three positions including a first position, a second position, and third position. The first position is a position in which the second frame is closed with respect to the first frame. The second position is a position in which, with respect to the first frame, the second frame is more open, by a first predetermined amount, than in the first position. The third position is a position in which, with respect to the first frame, the second frame is open by a second predetermined amount. The second predetermined amount is larger than the first predetermined amount. The lock mechanism includes a support member, a first rotation shaft, a lock release lever, a first energizing member, a second rotation shaft, a pressing lever, and a second energizing member. The support member includes a support portion and a rotation portion. The support portion supports the second frame on one end side of the support member. The rotation portion is rotatably supported with respect to the first frame at another end side of the support member. The lock release lever is rotatably supported with respect to the first frame by the first rotation shaft on the one end side and extends from the first rotation shaft to the other end side. The first energizing member energizes the lock release lever in a first rotation direction away from the first frame. The pressing lever is rotatably supported with respect to the first frame around the second rotation shaft. The pressing lever is provided with a plurality of concave portions and a pressing portion. Each of the plurality of concave portions is recessed toward the second rotation shaft. The each of the plurality of concave portions is configured to engage with an end portion on the one end side of the lock release lever. The pressing portion is configured to press the support member to the first frame side with respect to the second frame. The second energizing member energizes the pressing lever to the side away from the first frame. The lock mechanism is configured to switch the position of the second frame with respect to the first frame by switching the concave portion engaged with the end portion of the lock release lever in accordance with an operation of one of the pressing lever and the lock release lever. The lock mechanism is configured to hold the second frame in each of the at least three positions. The lock release lever is configured to approach the frame support portion of the frame attachment member when the position of the second frame with respect to the first frame is the first position. The lock release lever is configured to come into contact with the frame support portion before the third position is reached to restrict the second frame from entering the third position with respect to the first frame, when the lock release lever is further operated to the first frame side with respect to the second frame. The third position is a position at which the distance between the first frame and the support portion is greatest.

Embodiments further provide a sewing machine that includes a needle bar on which a sewing needle is mountable, a presser foot, a needle plate, a movement mechanism, and an embroidery frame. The needle plate includes a needle hole through which the sewing needle is passable. The movement mechanism includes a holder and configured to move the holder. The embroidery frame includes a pair of a first frame and a second frame, and a lock mechanism. The embroidery frame is removably attached to the holder. The pair of the first frame and the second frame is configured to clamp a sewing object. The lock mechanism is configured to switch a position of the second frame with respect to the first frame to at least three positions including a first position, a second position, and a third position. The lock mechanism is configured to hold the second frame. The first position is a position in which the second frame is closed with respect to the first frame. The second position is a position in which, with respect to the first frame, the second frame is more open, by a first predetermined amount, than in the first position. The third position is a position in which, with respect to the first frame, the second frame is open by a second predetermined amount. The second predetermined amount is larger than the first predetermined amount. The second frame is positioned between the presser foot and the needle plate in a direction perpendicular to the needle plate under a condition in which the embroidery frame is attached to the holder and the position of the second frame with respect to the first frame is the second position.

BRIEF DESCRIPTION OF THE DRAWINGS

Embodiments will be described below in detail with reference to the accompanying drawings in which.

DETAILED DESCRIPTION

Hereinafter, embodiments of the present disclosure will be explained with reference to the drawings. A physical configuration of a multi-needle sewing machine (hereinafter simply referred to as the sewing machine) 1 and an embroidery frame 5 will be explained with reference to FIGS. 1 and 2. In the following explanation, the upper side, the lower side, the lower left side, the upper right side, the upper left side, and the lower right side of FIG. 1 respectively correspond to the upper side, the lower side, the front side, the rear side, the left side, and the right side of the sewing machine 1 and the embroidery frame 5.

Figure 1:
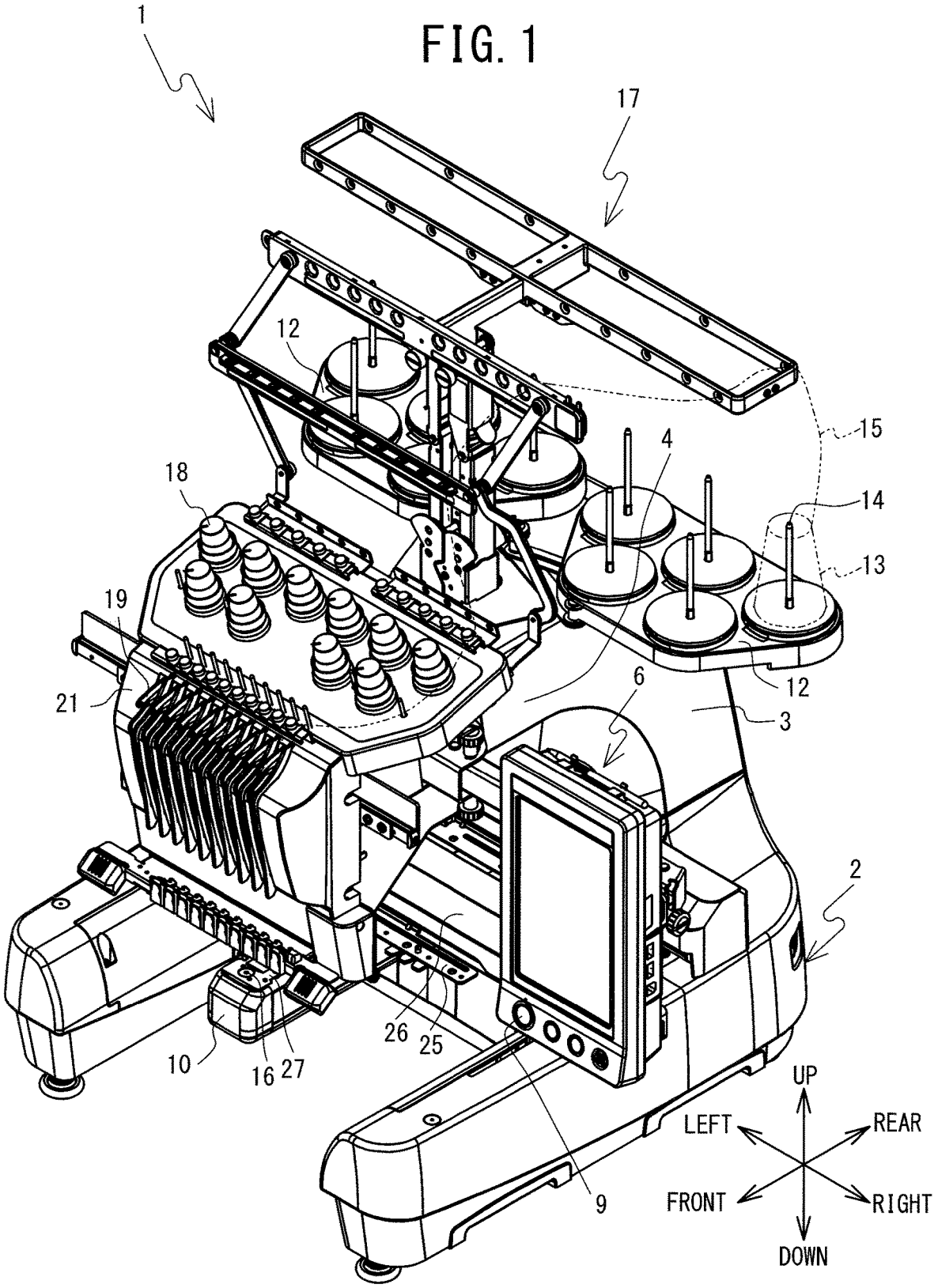
FIG. 1 is a perspective view of a sewing machine on which an embroidery frame unit is not mounted.
Figure 2:
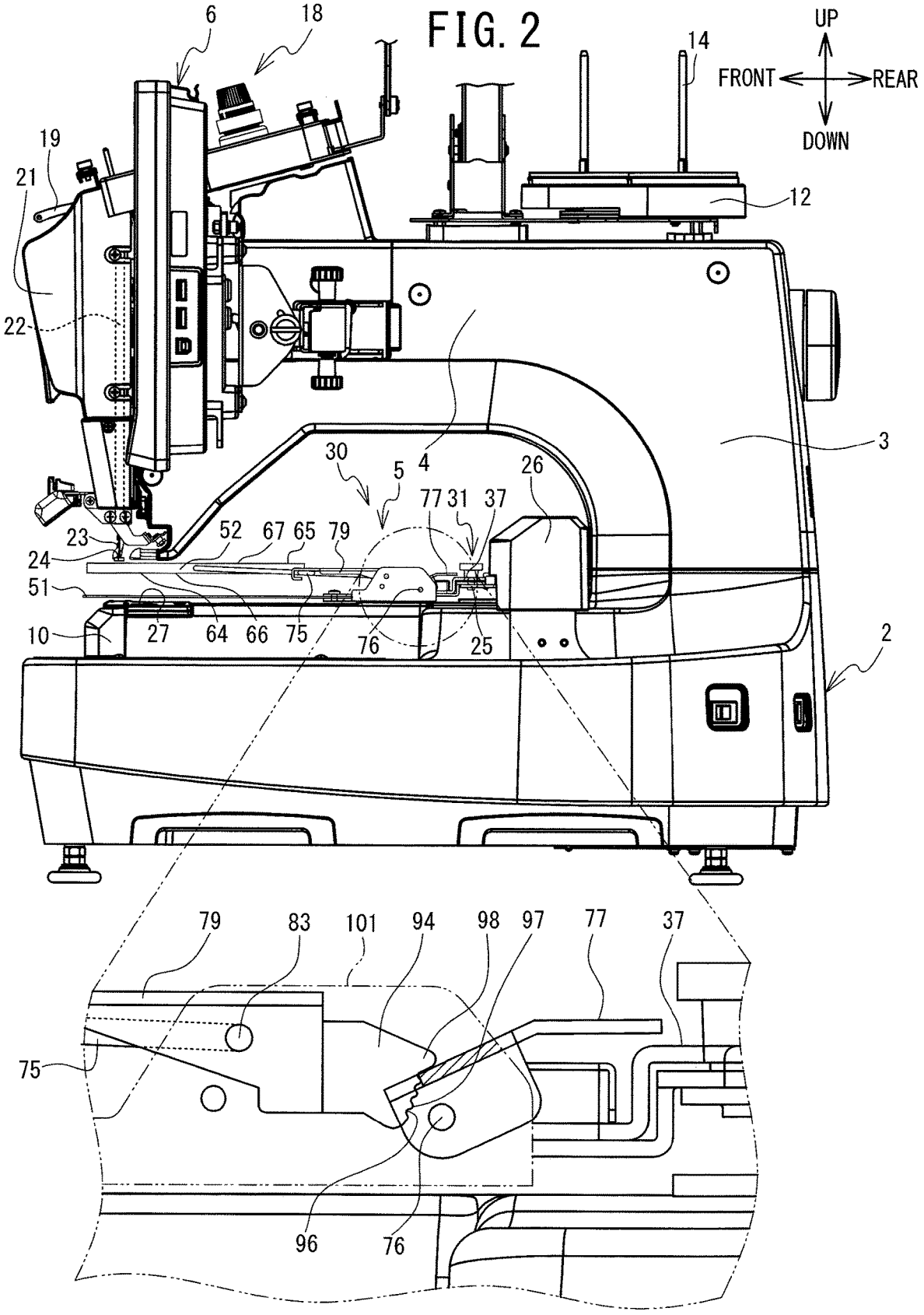
FIG. 2 is a right side view of the sewing machine on which the embroidery frame unit is mounted.

As shown in FIGS. 1 and 2, the sewing machine 1 is provided with a support portion 2, a pillar 3, and an arm portion 4. The support portion 2 supports the whole of the sewing machine 1. The pillar 3 is provided in a standing manner extending upward from the rear end portion of the support portion 2. The arm portion 4 extends to the front from the upper end portion of the pillar 3. A needle bar case 21 is mounted on the leading end of the arm portion 4 such that the needle bar case 21 can move in the left-right direction. Ten needle bars 22 (refer to FIG. 2), which extend in the up-down direction, and presser bars (not shown in the drawings) are disposed inside the needle bar case 21 at equal intervals in the left-right direction. Of the ten needle bars 22, the one needle bar 22 that is in a sewing position (a sewing needle bar) is caused to slide in the up-down direction by a needle bar drive mechanism (not shown in the drawings) that is driven by a drive shaft motor (not shown in the drawings). As shown in FIG. 2, a sewing needle 23 can be mounted on the lower end of each of the needle bars 22. A presser foot 24 can be mounted on the lower end of each of the presser bars, and is positioned above a needle plate 27 that will be described later. The presser foot 24 is configured to move, along with the presser bar, between a lowered position in which the presser foot 24 presses a sewing object C (refer to FIG. 8), and a raised position in which the presser foot 24 is retracted upward from the lowered position (has separated from the sewing object C). The presser foot 24 is configured to intermittently press the sewing object C downward in concert with the up and down movement of the needle bar 22. The sewing object C is, for example, a work cloth.

As shown in FIG. 1, an operation portion 6 is provided on the arm portion 4. The operation portion 6 is provided with a start/stop switch 9. The start/stop switch 9 is used when inputting a command to start or to stop sewing. As shown in FIGS. 1 and 2, a cylinder-shaped cylinder bed 10, which extends to the front from the lower end portion of the pillar 3, is provided below the arm portion 4. A shuttle (not shown in the drawings) is provided inside the leading end portion of the cylinder bed 10. The shuttle houses a bobbin (not shown in the drawings) on which a lower thread (not shown in the drawings) is wound. A shuttle drive mechanism (not shown in the drawings) is provided inside the cylinder bed 10. The shuttle drive mechanism is configured to rotationally drive the shuttle. The needle plate 27, which is rectangular in a plan view, is provided on the top surface of the cylinder bed 10. A needle hole 16, through which the sewing needle 23 can pass, is provided in the needle plate 27. Of the ten needle bars 22, the needle bar 22 positioned directly above the needle hole 16 is the sewing needle bar. Further, a movement mechanism 20 is provided below the arm portion 4. The movement mechanism 20 is provided with a holder 25, a Y carriage 26, and an X carriage 28 (refer to FIG. 3). The holder 25 is configured to removably support the embroidery frame 5, via a frame attachment member 31. The embroidery frame 5 is configured to hold the sewing object C. The movement mechanism 20 is configured to move the embroidery frame 5 mounted on the holder 25 to a position indicated using a unique XY coordinate system (an embroidery coordinate system). A pair of left and right thread spool bases 12 are provided on a back surface side of the top surface of the arm portion 4. A plurality of thread spool pins 14 are provided on each of the thread spool bases 12. Each of the thread spool pins 14 is configured to support thread spools 13. An upper thread 15 is supplied from one of the thread spools 13 mounted on the thread spool bases 12. The upper thread 15 is supplied to an eye (not shown in the drawings) of each of the sewing needles mounted on the lower ends of the needle bars 22, via a thread path. The thread path includes a thread guide 17, a tensioner 18, and a thread take-up lever 19.

Figure 3:
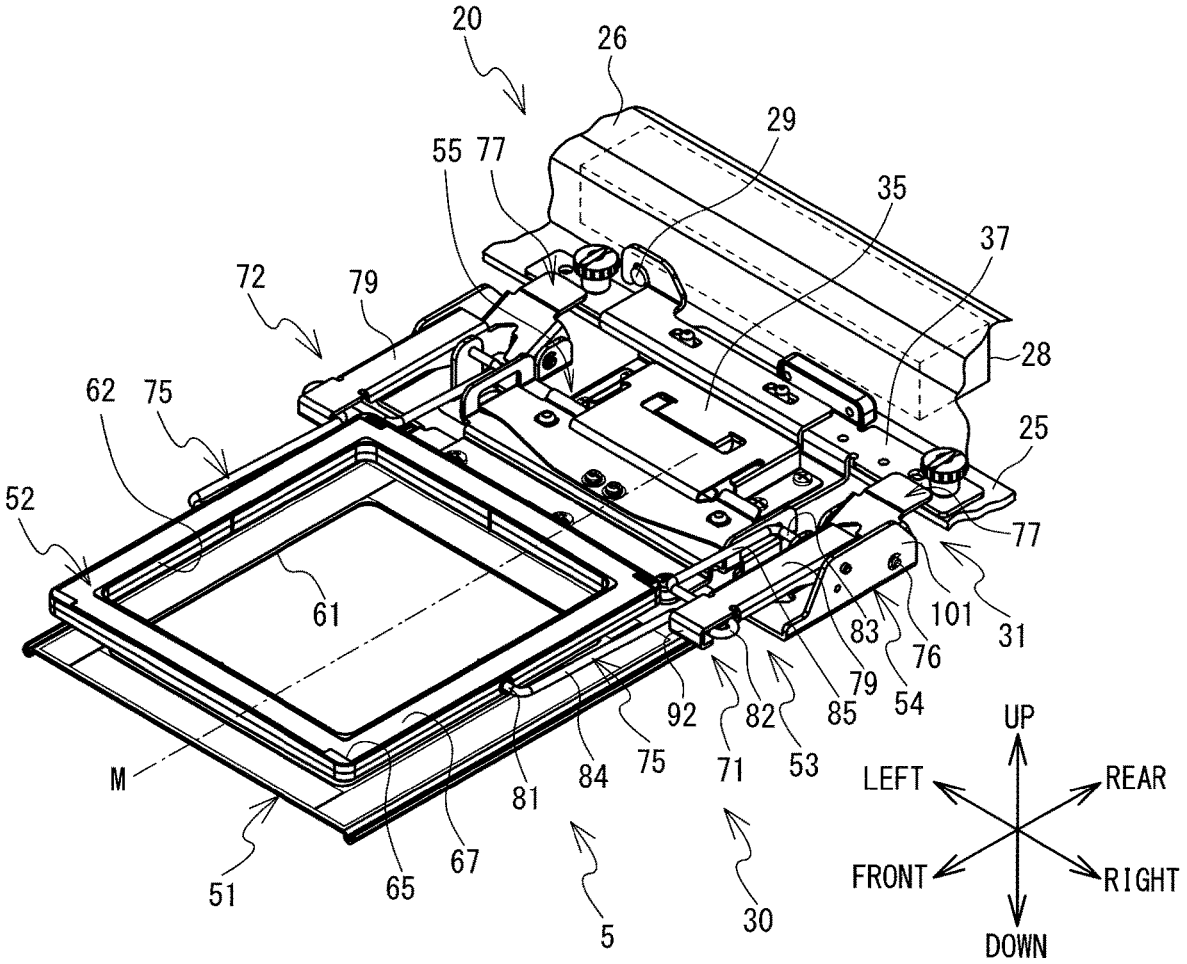
FIG. 3 is a perspective view of the embroidery frame unit.

An operation to form stitches on the sewing object C held by the embroidery frame 5 will be explained with reference to FIG. 1 to FIG. 3. The embroidery frame 5 holding the sewing object C is supported by the holder 25 of the movement mechanism 20, via the frame attachment member 31. As a result of the needle bar case 21 moving to the left and the right, one of the ten needle bars 22 is selected as the sewing needle bar. The embroidery frame 5 is moved to a predetermined position by the movement mechanism 20. The needle bar drive mechanism and a thread take-up lever drive mechanism are driven by the drive shaft motor, and the selected needle bar 22 and the thread take-up lever 19 corresponding to the selected needle bar 22 are moved up and down. Further, the shuttle drive mechanism is driven by the rotation of the drive shaft motor, and the shuttle is rotationally driven. In this way, the sewing needle 23, the thread take-up lever 19, and the shuttle are driven in synchronization, and the stitches are formed on the sewing object C.

An embroidery frame unit 30 provided in the sewing machine 1 will be explained with reference to FIG. 2 to FIG. 8. The embroidery frame unit 30 is a member that is removably mounted on the sewing machine 1. The embroidery frame unit 30 is provided with the embroidery frame 5, and the frame attachment member 31. The embroidery frame 5 includes a first frame 51 and a second frame 52. The embroidery frame 5 can hold the sewing object C using the first frame 51 and the second frame 52. The frame attachment member 31 is removably attached to the holder 25. The embroidery frame 5 is removably mounted on the frame attachment member 31. In other words, the embroidery frame 5 can be mounted on the sewing machine 1 of the present embodiment via the frame attachment member 31.

Figure 4:
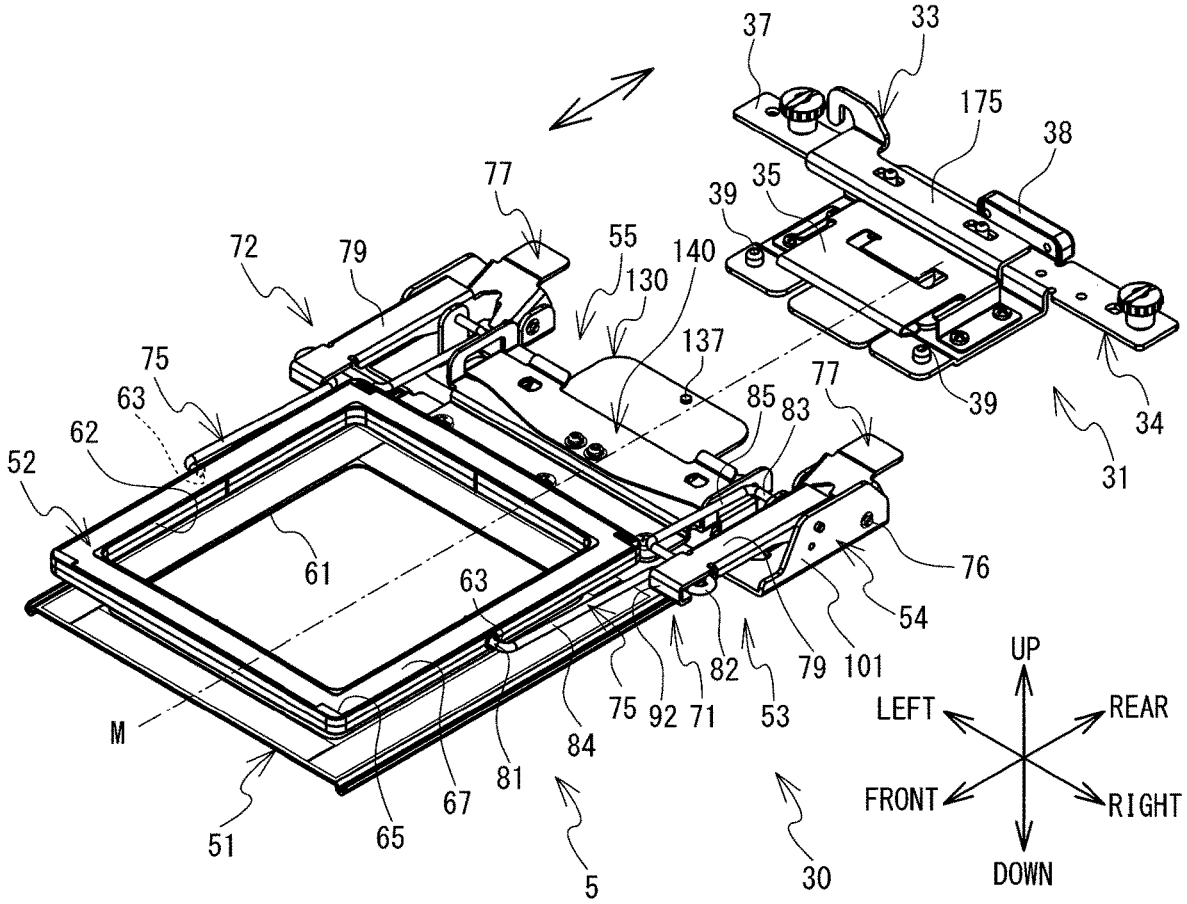
FIG. 4 is a perspective view of the embroidery frame unit in a state in which an embroidery frame is removed from a frame attachment member.
Figure 5:
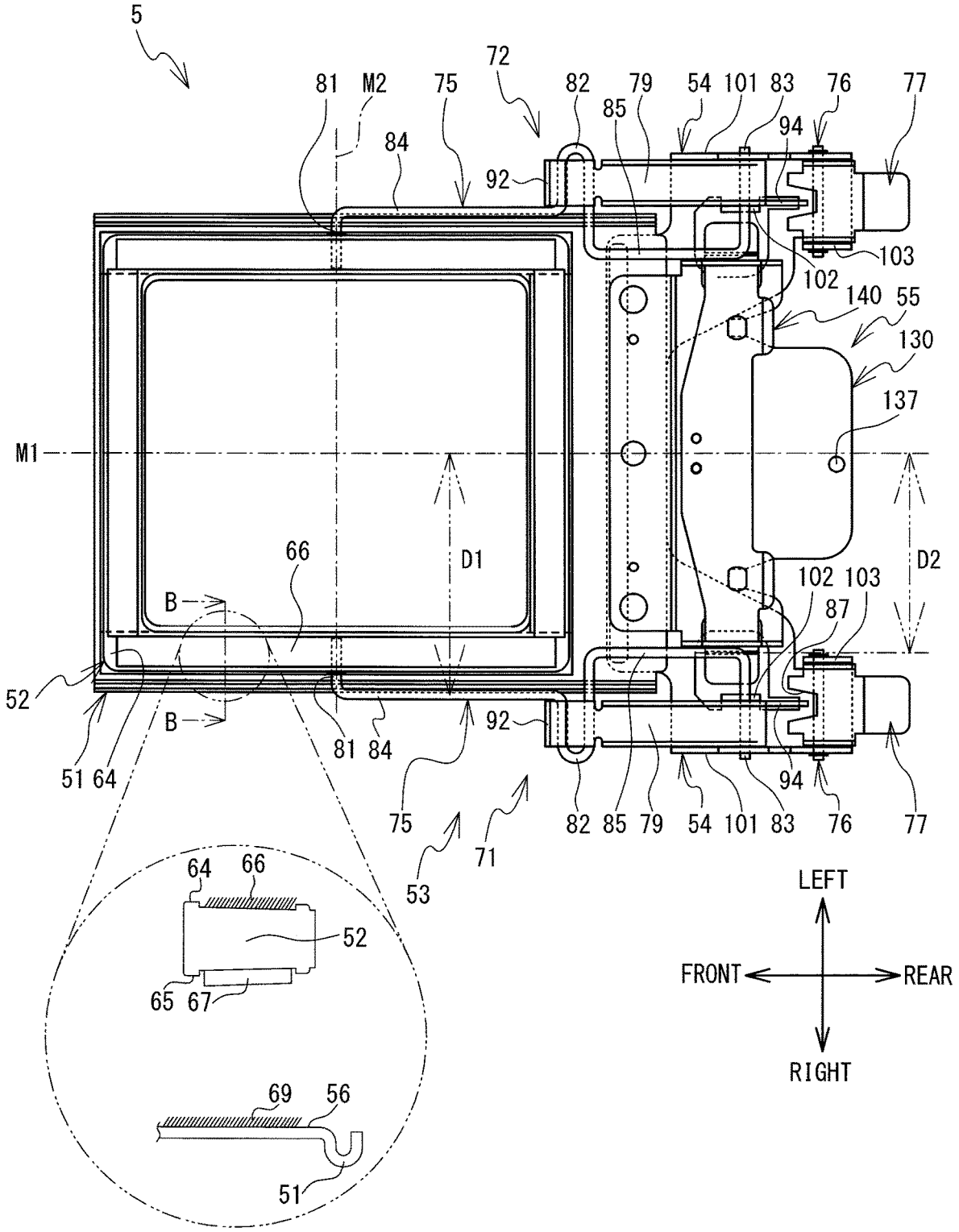
FIG. 5 includes a plan view of the embroidery frame, and a partial cross-sectional view in the direction of arrows along a line B-B.

As shown in FIG. 3 to FIG. 6, in addition to the first frame 51 and the second frame 52, the embroidery frame 5 is provided with a lock mechanism 53, a support plate 54, and an attachment member 55. The first frame 51 and the second frame 52 are frame-shaped members that are rectangular in a plan view. The sewing object C can be disposed between the first frame 51 and the second frame 52. The second frame 52 is rotatably supported with respect to the first frame 51 by the lock mechanism 53. As shown in FIG. 5, in a plan view, the outer shape of the first frame 51 is larger than the outer shape of the second frame 52. The first frame 51 has a hole 61 that is rectangular in a plan view and that penetrates the first frame 51 in the thickness direction of the first frame 51. An attachment portion 68 is provided on the rear end side end portion of the first frame 51, for attaching the first frame 51 to the support plate 54 and the attachment member 55. The second frame 52 has a hole 62 that is rectangular in a plan view and that penetrates the second frame 52 in the thickness direction of the second frame 52. When the second frame 52 is in a closed position (a first position to be described later) with respect to the first frame 51, the shape of the hole 62 in the plan view and the shape of the hole 61 in the plan view substantially match each other.

Figure 6:
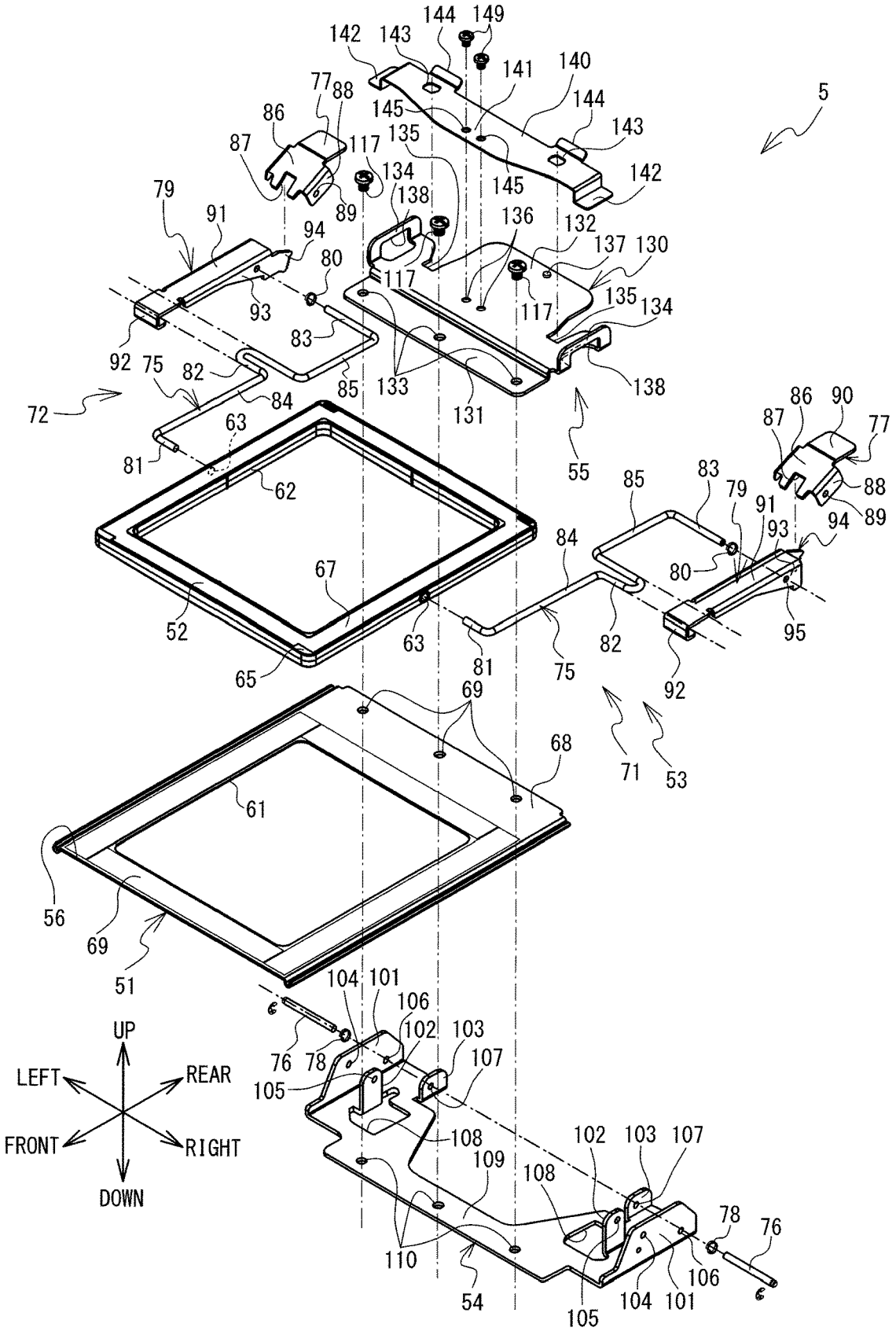
FIG. 6 is an exploded perspective view of the embroidery frame.

As shown in FIG. 6, holes 63, which are circular in a side view, are provided in a right side surface and a left side surface of the second frame 52. The holes 63 are provided on a central line M2 (refer to FIG. 5) of the longitudinal direction (the front-rear direction in FIG. 6) of the surfaces in which the holes 63 are provided. Specifically, the holes 63 are provided substantially in the center of the sides, of the four sides of the rectangular second frame 52, in which the holes 63 are provided. The holes 63 are provided substantially in the center in the thickness direction (the up-down direction in FIG. 6) of the second frame 52.

As shown in FIG. 2 and FIG. 5, the second frame 52 includes a first anti-slip portion 66, in a first surface 64. The second frame 52 includes a second anti-slip portion 67, in a second surface 65. The second surface 65 is a surface on the opposite side to the first surface 64. Each of the first anti-slip portion 66 and the second anti-slip portion 67 is provided in order to suppress the sewing object C, which is disposed between the first frame 51 and the second frame 52, from moving with respect to the second frame 52. The first anti-slip portion 66 and the second anti-slip portion 67 of the present embodiment have mutually different physical properties. As shown by a partial cross-sectional view as seen from the front along a line B-B in FIG. 5, the first anti-slip portion 66 of the present embodiment is a pile member having short fibers that extend in an inclined manner from the inside to the outside of the second frame 52, as they separate from the first surface 64. The first anti-slip portion 66 has a thin sheet shape that is rectangular in a plan view, and is adhered to the first surface 64, of the four sides of the rectangular second frame 52. The second anti-slip portion 67 is, for example, an abrasive grain sheet on which minute abrasive grains (such as emery sand, glass or the like) are firmly adhered to a sheet-shaped base surface, or a sheet-shaped urethane foam is adhered to the second surface 65, of the four sides of the rectangular second frame 52. On the first frame 51, an anti-slip portion 69 is provided on a surface 56 facing the second frame 52. The anti-slip portion 69 is provided in order to suppress the sewing object C disposed between the first frame 51 and the second frame 52 from moving with respect to the first frame 51. The anti-slip portion 69 may be the same material as one of the first anti-slip portion 66 and the second anti-slip portion 67, or may be a different material.

As will be described later, the embroidery frame 5 of the present embodiment is configured such that, the posture of the second frame 52 with respect to the first frame 51, for clamping and holding the sewing object C, can be changed between a first posture and a second posture. As shown in FIG. 2, the first posture is a posture in which the first surface 64 of the second frame 52 faces the first frame 51. As shown in FIG. 5, the second posture is a posture in which the second surface 65 of the second frame 52 faces the first frame 51. A user can switch the posture of the second frame 52 with respect to the first frame 51 to one of the first posture and the second posture in accordance with a material of the sewing object C. For example, when the sewing object C is a cotton material, a non-woven fabric or the like, the embroidery frame 5 is used in the first posture in which the first surface 64 to which the first anti-slip portion 66 is adhered faces the first frame 51. Further, for example, when the sewing object C is a vinyl material or the like, the embroidery frame 5 is used in the second posture in which the second surface 65 to which the second anti-slip portion 67 is adhered faces the first frame 51.

The lock mechanism 53 is configured to press the second frame 52 toward a first frame 51 side with respect to the second frame 52 (downward, hereinafter simply referred to as the first frame 51 side). The lock mechanism 53 of the present embodiment can switch a position of the second frame 52 with respect to the first frame 51 to three or more positions including the first position, a second position, and a third position, and can hold the second frame 52 at each of the first position and the second position. The position of the second frame 52 with respect to the first frame 51 will be described later. The lock mechanism 53 of the present embodiment includes a pair of a right and left first lock mechanism 71 and second lock mechanism 72. The first lock mechanism 71 rotatably supports the second frame 52 on one side (the right side) of the second frame 52, is configured to switch the position of the second frame 52 with respect to the first frame 51 to one of the three or more positions, and is configured to hold the second frame 52 at each of the first position and the second position. The second lock mechanism 72 rotatably supports the second frame 52 on the side (the left side) opposite to the one side of the second frame 52, and separately from the first lock mechanism 71, is configured to switch the position of the second frame 52 with respect to the first frame 51 to one of the three or more positions, and is configured to hold the second frame 52 at each of the first position and the second position.

The first lock mechanism 71 and the second lock mechanism 72 are configured to be left-right symmetrical, with respect to a central line M1 (M) in the left-right direction of the embroidery frame 5. Each of the first lock mechanism 71 and the second lock mechanism 72 is provided with a support member 75, a rotation shaft 76, a lock release lever 77, a first energizing member 78, a pressing lever 79, and a second energizing member 80. Below, the configuration of the lock mechanism 53 will be explained taking the first lock mechanism 71 as an example, and an explanation of the second lock mechanism 72 will be omitted. In the following explanation, a direction from the attachment member 55 toward the first frame 51 (the forward direction) is referred to as a removal direction and a one end side. A direction from the first frame 51 toward the attachment member 55 (the rearward direction) is referred to as a mounting direction and another end side. A direction orthogonal to the mounting direction on an extending surface of the first frame 51 of the embroidery frame 5 (the left-right direction) is also referred to as a width direction. The surface 56, of the first frame 51, that faces the second frame 52 is also referred to as an extending surface of the embroidery frame 5. A direction away from the central line M1 on the extending surface (a horizontal surface in the present embodiment) of the embroidery frame 5 is also referred to as a separating direction.

The support member 75 is a member formed by bending a circular bar-shaped elastic body. The support member 75 is provided with a support portion 81, a bent portion 82, a rotation portion 83, a front portion 84, and a rear portion 85. The support portion 81 rotatably supports the second frame 52 on the one end side of the support member 75. The support portion 81 is a portion at which one end of the circular bar-shaped elastic body is bent in a direction from the support member 75 toward the second frame 52. The support portion 81 is inserted into the hole 63 provided in the side surface of the second frame 52, and supports the second frame 52 such that the second frame 52 can rotate to the first posture and the second posture, around the support portion 81. When the user has widened a distance between the pair of support portions 81 on the left and the right, the support portions 81 are removed from the holes 63 of the second frame 52, and the second frame 52 is removed from the support members 75. In other words, the second frame 52 is removably supported by the support members 75.

The bent portion 82 is a U-shaped portion that is bent in an extending direction (a width direction) of the rotation shaft 76, substantially in a center portion in the front-rear direction of the support member 75. The rotation portion 83 is a portion at which one end of the circular bar-shaped elastic body is bent to the opposite side to the support portion 81. The rotation portion 83 is supported by the support plate 54 so as to be rotatable with respect to the first frame 51. As will be described later with reference to FIG. 8, the support member 75 is rotatable with respect to the first frame 51, around the rotation portion 83, at a position at which a distance L1 between the support portion 81 and the first frame 51 becomes half or more of the length of the side, among the sides of the second frame 52, that is supported by the support portion 81 (the length of the side extending in the front-rear direction in FIG. 5).

The front portion 84 is a portion extending in the front-rear direction between the support portion 81 and the bent portion 82. In a state shown in FIG. 5, the front portion 84 extends substantially in parallel to the sides in the front-rear direction of the second frame 52. In the state shown in FIG. 5, the rear portion 85 is a portion extending in the front-rear direction between the bent portion 82 and the rotation portion 83. A distance D1 between the central line M1 in the left-right direction of the embroidery frame 5 and the front portion 84 is longer than a distance D2 between the central line M1 and the rear portion 85. In other words, the rear portion 85 is closer to the central line M1 than the front portion 84. An insertion portion 134 of the attachment member 55 (to be described later) is disposed on the central line M1 side with respect to the rear portion 85. The support member 75 is restricted, by the insertion portion 134, from moving further to the central line M1 side than the insertion portion 134. Thus, the support member 75 is restricted from falling out from the support plate 54. As shown in FIG. 2 to FIG. 4, when the position of the second frame 52 with respect to the first frame 51 is the second position, the support portion 81, the bent portion 82, the rotation portion 83, the front portion 84, and the rear portion 85 are in substantially the same plane.

As shown in FIG. 6, the rotation shaft 76 is a metal bar-shaped shaft that extends in the left-right direction. The rotation shaft 76 is inserted through holes 106 and 107 in the support plate 54 to be described later, and through holes 89 of the lock release lever 77. The lock release lever 77 is supported by the rotation shaft 76 at the one end side so as to be rotatable with respect to the first frame 51. The lock release lever 77 is a member that extends from the rotation shaft 76 to the other end side that is opposite to the one end side. The lock release lever 77 is formed by machining a metal plate. The lock release lever 77 is provided with a main body portion 86, a pair of left and right support portions 88, and an operation portion 90. The main body portion 86 is a plate-shaped portion that extends substantially in parallel to the rotation shaft 76. A recessed portion 87, which is recessed toward the rear side (the operation portion 90 side with respect to the main body portion 86) is provided in the front end portion of the main body portion 86. The pair of left and right support portions 88 are portions that are respectively formed by bending the left end portion and the right end portion of the main body portion 86 toward the first frame 51 (downward) from an extending surface of the main body portion 86. The pair of support portions 88 are provided with the holes 89 that penetrate in the thickness direction (the left-right direction) of the support portions 88. The rotation shaft 76 is inserted into the holes 89. The operation portion 90 is a portion that is formed by bending the rear portion of the main body portion 86 to the first frame 51 side (downward).

The first energizing member 78 energizes the lock release lever 77 in a first rotation direction separating from the first frame 51. The first rotation direction of the present embodiment is the counterclockwise direction in a right side view. The first energizing member 78 is, for example, a torsion spring. The rotation shaft 76 is inserted through the first energizing member 78.

The pressing lever 79 is formed by machining a metal plate. The rotation portion 83 of the support member 75 is inserted into the pressing lever 79, and the pressing lever 79 is supported so as to be rotatable with respect to the first frame 51, around the rotation portion 83. The pressing lever 79 includes a main body portion 91, a pressing portion 92, a pair of left and right support portions 93, and an engagement portion 94. The main body portion 91 is a rectangular plate-shaped portion that is long in the front-rear direction in a plan view. The pressing portion 92 is a portion that is provided on the front portion of the pressing lever 79 and that is configured to press the support member 75 to the first frame 51 side. The pressing portion 92 is formed by machining the front end of the pressing lever 79 into a hook shape that is oriented downward. The pressing portion 92 holds the front portion of the bent portion 82 of the support member 75. The end portion of the bent portion 82 in the separating direction is more separated from the central line M1 than the end portion of the pressing portion 92 in the separating direction. The pair of left and right support portions 93 are portions that are respectively formed by bending the left end portion and the right end portion of the main body portion 91 toward the first frame 51 (downward) from an extending surface of the main body portion 91. The pair of support portions 93 are respectively provided with holes 95 that penetrate in the thickness direction (the left-right direction) of the support portions 93. The rotation portion 83 of the support member 75 is inserted into the holes 95, from the central line M1 side of the embroidery frame 5 with respect to the pressing lever 79.

The engagement portion 94 is provided on the rear end portion of the support portion 93 that is closest to the central line M1, of the pair of left and right support portions 93. As shown in FIG. 2, the engagement portion 94 is provided with a plurality of concave portions 96 and a plurality of convex portions 97. The concave portions 96 and the convex portions 97 are alternately formed. Each of the plurality of convex portions 97 is a portion that is adjacent to the concave portion 96 and protrudes to the side separating from the rotation portion 83, and the convex portions 97 are provided in a number corresponding to the plurality of concave portions 96. In the engagement portion 94 of the present embodiment, five of the convex portions 97 and four of the concave portions 96 are alternately disposed. Of the plurality of convex portions 97 provided on the pressing lever 79, a protrusion amount of a largest convex portion 98 that is positioned furthest away from the first frame 51 (namely, furthest to the top) is the largest with respect to the rotation shaft 76. The concave portions 96 is configured to engage with the recessed portion 87 provided on the one end side of the lock release lever 77.

The second energizing member 80 energizes the pressing lever 79 in a direction separating from the first frame 51. In the present embodiment, the second energizing member 80 energizes the pressing lever 79 in the clockwise direction in a right side view. Specifically, the second energizing member 80 energizes the bent portion 82 held by the pressing portion 92 of the pressing lever 79, and thus the support member 75, in the clockwise direction in a right side view. In this way, the second energizing member 80 indirectly energizes the second frame 52 in a direction separating from the first frame 51 (upward). In the embroidery frame 5, by switching the concave portion 96 with which the end portion of the lock release lever 77 is engaged, in accordance with an operation of one of the pressing lever 79 and the lock release lever 77, the position of the second frame 52 with respect to the first frame 51 is switched, and the second frame 52 is held.

As shown in FIG. 6, the support plate 54 is a metal plate-shaped member that extends in the left-right direction. The shape of the support plate 54 in a plan view is a U shape that is open to the rear. The support plate 54 includes a main body portion 109 and pairs of left and right support portions 101 to 103. The main body portion 109 is a plate-shaped portion that extends in the left-right direction and extends in substantially the horizontal direction. The main body portion 109 is provided with three screw holes 110 that penetrate the main body portion 109 in the thickness direction (the up-down direction) of the main body portion 109. Each of the pair of left and right support portions 101 is a portion formed by machining the left end portion and the right end portion of the plate-shaped member that is the material of the support plate 54 so as to bend upward from an extending surface of the main body portion 109. The pair of support portions 101 are each provided with a hole 104 and the hole 106 that penetrate the support portions 101 in the thickness direction (the left-right direction). The pairs of left and right support portions 102 and 103 are portions formed by machining portions of the plate-shaped member that is the material of the support plate 54 to bend upward so as to face the support portions 101. The pair of left and right support portions 102 are respectively provided with holes 105 in positions facing the holes 104. The pair of left and right support portions 103 are respectively provided with the holes 107 in positions facing the holes 106. The rotation portions 83 of the support members 75 are inserted through the holes 104 and 105. The rotation shaft 76 is inserted through the holes 106 and 107. The lower end portions of the pair of left and right portions 102 are adjacent to the holes 108 that penetrate the support plate 54 in the up-down direction. The engagement portions 94 of the pressing levers 79 can be inserted through the holes 108.

In a predetermined mounting position to be described later, the attachment member 55 is removably supported by the frame attachment member 31 provided on the sewing machine 1. The attachment member 55 includes an attachment member 130 and a positioning member 140. The attachment member 130 is provided with a coupling portion 131 and an attachment portion 132. The coupling portion 131 includes a plate-shaped portion that extends in the horizontal direction on the front portion of the attachment member 130. The coupling portion 131 has three holes 133 that penetrate the coupling portion 131 in the up-down direction. The coupling portion 131 is disposed on the upper portion of the attachment portion 68 of the first frame 51, and the attachment member 130, the first frame 51, and the support plate 54 are coupled with each other using screws 117.

The attachment portion 132 is a portion that is removably supported by the frame attachment member 31. The attachment portion 132 is formed on the rear portion of the attachment member 130. The attachment portion 132 is provided with the pair of left and right insertion portions 134, a pair of left and right guide portions 135, a pair of left and right screw holes 136, and a protrusion 137. The pair of left and right insertion portions 134 are formed by bending the end portions in the left-right direction of the attachment portion 132 upward, and each has a hole 138. The pair of left and right guide portions 135 are provided between the pair of insertion portions 134, in the left-right direction. Each of the pair of guide portions 135 is a portion formed by being cut out in a substantial V shape in a plan view. The protrusion 137 protrudes downward, in the vicinity of the center, in the left-right direction, of the rear portion of the attachment portion 132. The position of the protrusion 137 in the left-right direction in relation to the attachment portion 132 is set as a position that is unique to the embroidery frame 5.

The positioning member 140 is a member that prescribes the mounting position of the attachment member 130. The positioning member 140 is a flexible plate spring member that extends in the left-right direction. The positioning member 140 includes a main body portion 141, a pair of left and right tab portions 142, a pair of left and right engagement portions 143, and a pair of left and right inclined portions 144. The main body portion 141 is a plate-shaped portion that extends in the left-right direction. A pair of left and right holes 145 are provided in substantially the center portion, in the left-right direction, of the front portion of the main body portion 141. Each of the pair of holes 145 is provided in a position corresponding to each of the screw holes 136 of the attachment member 130. The center portion, in the left-right direction, of the front portion of the positioning member 140 is fixed to the attachment member 130 using a pair of screws 149. The pair of tab portions 142 are provided on the left end and the right end of the positioning member 140, respectively. Each of the pair of tab portions 142 is a portion that can move the position of the positioning member 140 in the up-down direction, by an operation of the user. As shown in FIG. 3 and FIG. 4, the tab portions 142 are inserted into the holes 138 of the attachment member 130.

As shown in FIG. 6, each of the pair of engagement portions 143 is a hole that is provided in the vicinity of each of the pair of tab portions 142 and penetrates the positioning member 140 in the up-down direction. Each of the pair of engagement portions 143 is an elliptical shape that is long in the left-right direction in a plan view. When the attachment member 130 has been moved to the mounting position, each of the pair of engagement portions 143 engages with each of the engagement portions 39 (refer to FIG. 7) provided in the frame attachment member 31 of the sewing machine 1, and restricts the movement of the attachment member 130 in the horizontal direction. Each of the pair of left and right inclined portions 144 is inclined such that, in the front-rear direction, the further toward the engagement portions 143 side from the inclined portions 144, the smaller the distance from the attachment member 130. The inclined portions 144 are formed by bending the rear portion of the plate-shaped member that is the material of the positioning member 140 diagonally upward and to the rear in a right side view. In the course of moving the attachment member 130 to the mounting position, each of the inclined portions 144 guides the engagement portions 39 toward the engagement portions 143.

Figure 7:
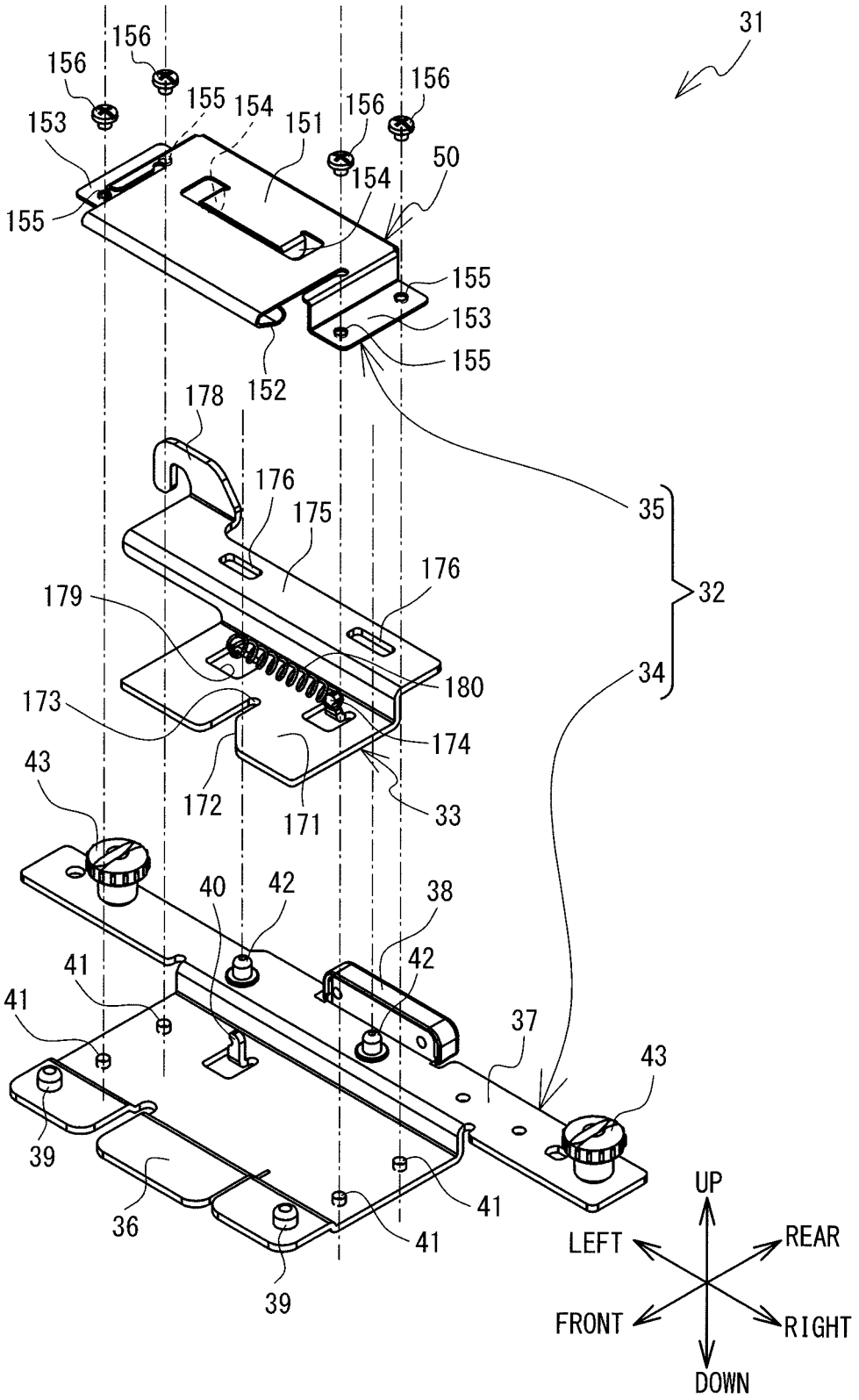
FIG. 7 is an exploded perspective view of the frame attachment member.

The frame attachment member 31 will be explained with reference to FIG. 7. The frame attachment member 31 removably mounts the embroidery frame 5 on the sewing machine 1. As shown in FIG. 7, the frame attachment member 31 is mainly provided with an attachment portion 32 and a switching plate 33. The embroidery frame 5 is configured to be mounted on the attachment portion 32. The attachment portion 32 is mainly provided with an attachment member 34 and a pressing member 35. The attachment member 34 is a plate member that extends in the left-right direction, and is mainly provided with a plate portion 36, a frame support portion 37, and a guide portion 38. The plate portion 36 is a plate-shaped portion that extends substantially horizontally on the front side of the attachment member 34. The plate portion 36 is provided with the pair of left and right engagement portions 39, a support portion 40, and four screw holes 41. Screws 156 to be described later are respectively screwed into the four screws holes 41. The pair of engagement portions 39 are provided on the left front portion and the right front portion, respectively, of the plate portion 36, and are pin-shaped protruding portions that protrude upward. The leading end (the upper end) of each of the pair of engagement portions 39 is chamfered into a smooth hemispherical shape. When the embroidery frame 5 has been moved to the mounting position, the pair of engagement portions 39 can respectively engage with the pair of engagement portions 143 provided in the embroidery frame 5. The support portion 40 is a portion that is formed by bending upward a portion of the plate-shaped member that is the material of the attachment member 34, from the extending surface of the plate portion 36. The support portion 40 is inserted into a through hole 179 of the switching plate 33, and supports the left end of an energizing member 180 (a coil spring, for example).

The frame support portion 37 is a plate-shaped member that extends in the left-right direction. The frame support portion 37 fixes the frame attachment member 31 to the holder 25 (refer to FIG. 2) of the movement mechanism 20, and the frame support portion 37 is a portion that guides the movement of the switching plate 33. The frame support portion 37 is provided with a pair of left and right guide pins 42, and holes (not shown in the drawings) that penetrate the frame support portion 37 in the up-down direction. The pair of left and right guide pins 42 protrude upward from the top surface of the frame support portion 37. The guide pins 42 are respectively inserted into long holes 176 of the switching plate 33, and prescribe the movement direction of the switching plate 33 to be the left-right direction. The frame support portion 37 is fixed to the holder 25 by a pair of thumb screws 43 being inserted into the holes and tightened. The guide portion 38 is a plate-shaped portion that extends upward from the central portion of the rear end of the frame support portion 37.

The pressing member 35 is a plate spring member that energizes the attachment member 130 of the embroidery frame 5 mounted on the frame attachment member 31 to the attachment member 34 side with respect to the attachment member 130. The pressing member 35 is provided with a main body 151, a pressing portion 152, a pair of left and right fixing portions 153, and a pair of left and right pushing portions 154. The main body 151 is a rectangular shape that is long in the left-right direction in a plan view. The pressing portion 152 is a V-shaped portion in a right side view, and has a surface that is inclined diagonally downward and to the rear from the front end of the main body 151. When the attachment member 130 is positioned in the mounting position, the pressing portion 152 is disposed on the upper side of the attachment member 130, and energizes the attachment member 130 to the attachment member 34 side (to the lower side) with respect to the attachment member 130. When the tab portions 142 are manipulated in the state in which the attachment member 130 is positioned in the mounting position, the pressing portion 152 of the pressing member 35 further energizes the positioning member 140 in the removal direction. The removal direction is the movement direction of the attachment member 130 when causing the attachment member 130 to move from the mounting position. The removal direction of the present embodiment is the direction opposite to the mounting direction, and is the direction from the rear toward the front. The pair of fixing portions 153 are respectively connected to the left end and the right end of the main body 151. The pair of fixing portions 153 are respectively provided with a pair of through holes 155 that are aligned in the front-rear direction. The pressing member 35 is fixed to the attachment member 34 by the screws 156 respectively inserted through the through holes 155. Each of the pushing portions 154 is a portion that is formed by bending a portion of the center portion of the main body 151 to the attachment member 34 side with respect to the main body 151 (downward). Each of the pushing portions 154 can press the attachment member 130 positioned in the mounting position toward the attachment member 34 side with respect to the pushing portions 154 (the lower side in the present embodiment) from above.

The switching plate 33 is a moving member that is configured to move to the right in concert with an operation of mounting the attachment member 130 of the embroidery frame 5 on the attachment portion 32, and a movement amount of the switching plate 33 is set in accordance with the type of the embroidery frame 5. The switching plate 33 includes plate portions 171 and 175, and an engagement portion 178. The plate portion 171 is a plate-shaped portion that extends in the horizontal direction on the front side of the switching plate 33. The plate portion 171 is disposed above the plate portion 36 of the attachment member 34, and below the pressing member 35. The plate portion 171 is provided with contact portions 172 and 173, a support portion 174, and the through hole 179. The contact portion 172 is a portion that is formed by being cut out in a large reverse V shape in a plan view, on one side on the front side of the plate portion 171, and guides the protrusion 137 of the embroidery frame 5 to the contact portion 173. When the embroidery frame 5 is mounted on the sewing machine 1, the contact portion 173 is a portion that comes into contact with and holds the protrusion 137 of the embroidery frame 5. The support portion 174 is a portion that protrudes upward from the extending surface of the plate portion 171, and supports the right end of the energizing member 180. The switching plate 33 is energized to the left by the energizing member 180.

The plate portion 175 is a plate-shaped portion that extends in the left-right direction, and is provided with the pair of left and right long holes 176. Each of the pair of long holes 176 extends in the left-right direction. The guide pins 42 are respectively inserted into the pair of long holes 176. The engagement portion 178 is a portion that extends upward in a hooked shape from the rear left end portion of the plate portion 175, and engages with a detection element 29 (refer to FIG. 3) of a rotary potentiometer (not shown in the drawings). The detection element 29 rotates in accordance with the movement amount of the switching plate 33. As a result, the rotary potentiometer is configured to detect the rotation amount of the switching plate 33 on the basis of a rotation amount of the detection element 29. The sewing machine 1 is configured to detect the type of the embroidery frame 5 on the basis of the rotation amount of the detection element 29 detected by the rotary potentiometer.

An operation to mount the embroidery frame 5 on the sewing machine 1 will be explained with reference to FIG. 3 and FIG. 4. As a result of the user inserting the pair of thumb screws 43 into the holes (not shown in the drawings) of the frame support portion 37, and holes (not shown in the drawings) of the holder 25, and tightening the thumb screws 43, the frame attachment member 31 is attached to the holder 25. The user moves the presser foot 24 to the raised position. The raised position is the highest position within a movement range of the presser foot 24. When the presser foot 24 is in the raised position, a distance between the presser foot 24 and the needle plate 27 is larger than a length from the bottom end of the first frame 51 to the top end of the second frame 52 when the position of the second frame 52 with respect to the first frame 51 is the first position. When the embroidery frame 5 is mounted on the frame attachment member 31 of the sewing machine 1, first, the user moves the embroidery frame 5 horizontally in the mounting direction (rearward) to a position at which the engagement portions 39 come into contact with the inclined portions 144. The protrusion 137 is accommodated in the contact portion 173 while being guided by the contact portion 172. At this time, the switching plate 33 moves to the right in accordance with the position of the protrusion 137 with respect to the attachment portion 132. When the user horizontally moves the embroidery frame 5 further in the mounting direction, the pair of engagement portions 39 are respectively guided, in the horizontal direction, to the engagement portions 143 by the guide portions 135, and engage with the engagement portions 143. As a result of the pair of engagement portions 39 respectively engaging with the pair of engagement portions 143, the movement of the attachment member 130 in the horizontal direction is restricted, and the position of the embroidery frame 5 in the horizontal direction is fixed. The attachment member 130 is pressed from above by the pressing portion 152 and the pushing portions 154 of the pressing member 35, and thus, the attachment member 130 is clamped between the pressing member 35 and the attachment member 34. The position of the attachment member 130 is fixed in the up-down direction. As a result of the above operations, the embroidery frame 5 is mounted on the frame attachment member 31 of the sewing machine 1. The sewing machine 1 can detect the type of the embroidery frame 5 by detecting the movement amount of the switching plate 33 on the basis of the rotation amount of the detection element 29.

When the embroidery frame 5 is removed from the frame attachment member 31 mounted on the sewing machine 1, the user lifts the tab portions 142 upward. When the tab portions 142 are lifted upward, the positioning member 140 deforms and the engagement portions 143 are respectively disposed higher than the upper ends of the engagement portions 39. The positioning member 140 receives a force in the removal direction from the pressing portion 152. The attachment member 130 becomes able to move in the horizontal direction, and the user can use the force from the pressing portion 152 in the removal direction to smoothly move the embroidery frame 5 horizontally and in the removal direction. In other words, the user can easily remove the embroidery frame 5 from the mounting position. By loosening the pair of thumb screws 43, the user can remove the frame attachment member 31 from the holder 25.

The positions of the second frame 52 with respect to the first frame 51 will be explained with reference to FIG. 8. The embroidery frame 5 can switch the position of the second frame 52 with respect to the first frame 51 to the three or more positions including the first position, the second position, and the third position, and can hold the second frame 52 in each of the first position and the second position. In a state in which the position of the second frame 52 with respect to the first frame 51 is the first position, the lock mechanism 53 of the present embodiment can hold the second frame 52 by switching a position of the pressing lever 79 with respect to the lock release lever 77 to a first pressing position and a second pressing position. The first pressing position is a position in which a first pressure is applied to the second frame 52 toward the first frame 51 side. The second pressing position is a position in which a second pressure is applied to the second frame 52 toward the first frame 51 side. The second pressure is larger than the first pressure. In the state in which the position of the second frame 52 with respect to the first frame 51 is the first position, the lock mechanism 53 of the present embodiment can further hold the second frame 52 by switching the position of the pressing lever 79 with respect to the lock release lever 77 to a third pressing position in which a third pressure is applied to the second frame 52 toward the first frame 51. The third pressure is larger than the second pressure. A distance between the first frame 51 and the second frame 52 can also be said to be a distance between the first frame 51 and the support portion 81 of the support member 75.

The first position is a position in which the second frame 52 is closed with respect to the first frame 51. When the sewing object C is not present between the first frame 51 and the second frame 52, in the first position, the distance between the first frame 51 and the second frame 52 is zero. Of the above-described three or more positions of the second frame 52 with respect to the first frame 51, the distance between the first frame 51 and the second frame 52 is smallest in the first position. When the position of the second frame 52 with respect to the first frame 51 is the first position, the sewing object C can be held by the first frame 51 and the second frame 52.

Figure 8:
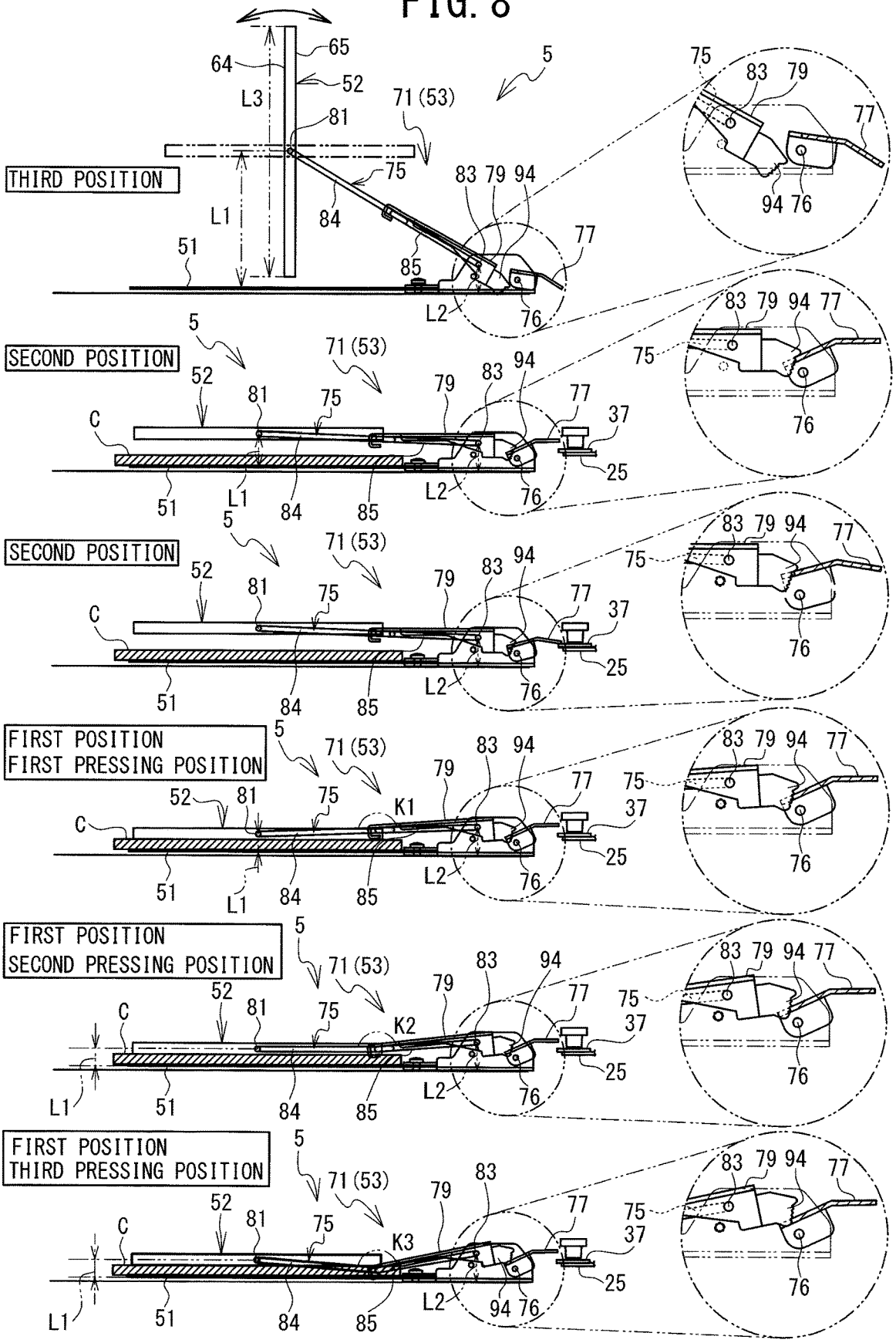
FIG. 8 includes right side views of the embroidery frame unit when a position of a second frame with respect to a first frame is a first position, a second position, and a third position.

As shown in FIG. 8, in the first position, when the position of the pressing lever 79 with respect to the lock release lever 77 is the first pressing position, the recessed portion 87 of the lock release lever 77 engages with the concave portion 96 that is in the position third closest to the first frame 51 (namely, third from the bottom), of the concave portions 96 of the engagement portion 94 of the pressing lever 79. In this case, in a right side view, an angle of an angle K1 in the clockwise direction from the front portion 84 of the support member 75 toward the rear portion 85 is roughly 180 degrees. When the position of the pressing lever 79 with respect to the lock release lever 77 is the second pressing position, the recessed portion 87 of the lock release lever 77 engages with the concave portion 96 that is in the position second closest to the first frame 51 (namely, second from the bottom), of the concave portions 96 of the engagement portion 94 of the pressing lever 79. In this case, in a right side view, an angle of an angle K2 in the clockwise direction from the front portion 84 of the support member 75 toward the rear portion 85 is smaller than 180 degrees. When the position of the pressing lever 79 with respect to the lock release lever 77 is the third pressing position, the recessed portion 87 of the lock release lever 77 engages with the concave portion 96 that is in the position closest to the first frame 51 (namely, furthest to the bottom), of the concave portions 96 of the engagement portion 94 of the pressing lever 79. In this case, in a right side view, an angle of an angle K3 in the clockwise direction from the front portion 84 of the support member 75 toward the rear portion 85 is smaller than 180 degrees and is smaller than the angle K2. The support member 75 appropriately releases the pressure applied from the pressing portion 92 of the pressing lever 79 using the elastic deformation of the front portion 84 with respect to the rear portion 85. To increase a pressing force on the sewing object C clamped between the first frame 51 and the second frame 52, the user presses the pressing portion 92 to the first frame 51 side and switches the engagement position of the pressing lever 79 and the lock release lever 77. To reduce the pressing force on the sewing object C clamped between the first frame 51 and the second frame 52, the user presses the lock release lever 77 to the first frame 51 side, and switches the engagement position of the pressing lever 79 and the lock release lever 77. In the present embodiment, whichever the position of the pressing lever 79 with respect to the lock release lever 77, the direction in which the force is applied from the pressing lever 79 toward the lock release lever 77 is the direction toward a rotation center (namely, the rotation shaft 76) of the lock release lever 77. The pressing lever 79 does not apply any force to the lock release lever 77 in the direction in which the lock release lever 77 rotates.

The second position is a position in which, with respect to the first frame 51, the second frame 52 is more open, by a first predetermined amount, than in the first position. The first predetermined amount may be set, for example, while taking into account a distance between the presser foot 24 (the needle bar 22) in the raised position and the needle plate 27, and thicknesses of the first frame 51 and the second frame 52. When the second frame 52 is in the second position, the holding of the sewing object C by the embroidery frame 5 is released and the user can move the sewing object C with respect to the embroidery frame 5. As shown in FIG. 2, in the state in which the embroidery frame 5 is mounted on the sewing machine 1 via the frame attachment member 31, when the position of the second frame 52 with respect to the first frame 51 is the second position, the second frame 52 is disposed between the presser foot in the raised position and the needle plate 27. Thus, when the position of the second frame 52 with respect to the first frame 51 is the second position, the second frame 52 does not come into contact with members provided in the sewing machine 1 (such as the needle bar 22, the needle bar case 21, and the arm portion 4, for example).

As shown in FIG. 8, when the second frame 52 is in the second position, the recessed portion 87 of the lock release lever 77 engages with the concave portion 96 that is in the position furthest away from the first frame 51 (namely, furthest to the top), of the concave portions 96 of the engagement portion 94 of the pressing lever 79. When the lock release lever 77 is operated to the first frame 51 side while the second frame 52 is in the second position, the rear end portion of the lock release lever 77 comes into contact with the frame support portion 37 of the frame attachment member 31. In this way, the rear end portion of the lock release lever 77 is restricted from moving further to the first frame 51 side than the frame support portion 37. As a result, in the state in which the embroidery frame 5 is held by the frame attachment member 31, the second frame 52 is restricted from moving to the third position. When the position of the second frame 52 with respect to the first frame 51 is the first position or the second position, the position of the pressing lever 79 that is engaged with the lock release lever 77 is determined by the energizing forces of the first energizing member 78 and the second energizing member 80, and thus, the second frame 52 does not rotate with respect to the first frame 51 around the rotation portion 83. Specifically, the lock mechanism 53 can hold the second frame 52 when the second frame 52 is in each of the first position and the second position with respect to the first frame 51.

The third position is a position in which, with respect to the first frame 51, the second frame 52 is open by a second predetermined amount that is larger than the first predetermined amount. In the embroidery frame 5 of the present embodiment, when the second frame 52 is in the third position with respect to the first frame 51, the first distance L1 between the support portion 81 of the support member 75 and the first frame 51 is longer than half of a length L3 of the second frame 52 in the front-rear direction. From among the lengths of the sides of the rectangular second frame 52, the length L3 is the length of the side supported by the support member 75 of the lock mechanism 53. In the diagram corresponding to the third position shown in FIG. 8, in order to release the pressing lever 79, a state is illustrated in which the user (not shown in the drawings) is pushing the lock release lever 77 downward while resisting the energizing force of the first energizing member 78. As shown in FIG. 8, from among the plurality of positions of the second frame 52 with respect to the first frame 51, in the third position in which the distance between the first frame 51 and the support portion 81 is greatest, the position of the lock release lever 77 passes beyond the largest convex portion 98, and the third position corresponds to a position in which the engagement of the pressing lever 79 and the lock release lever 77 is released. The recessed portion 87 of the lock release lever 77 is disposed more to the side away from the first frame 51 than the engagement portion 94 of the pressing lever 79 (namely, disposed above the engagement portion 94).

The lock mechanism 53 of the present embodiment supports the second frame 52 such that the second frame 52 can rotate to the first posture in which the first surface 64 faces the first frame 51, and the second posture in which the second surface 65 of the second frame 52, which is on the opposite side to the first surface 64, faces the first frame 51. When the position of the second frame 52 with respect to the first frame 51 is the third position, by causing the second frame 52 to rotate around the support portion 81, the user can switch the posture of the second frame 52 with respect to the first frame 51 from the first posture to the second posture, or from the second posture to the first posture. The lock mechanism 53 is configured to press the second frame 52 in at least the first posture to the first frame 51 side. The lock mechanism 53 of the present embodiment is configured to press the second frame 52 to the first frame 51 side in each of the first posture and the second posture.

In the diagram corresponding to the third position shown in FIG. 8, when the second frame 52 that is disposed perpendicularly with respect to the first frame 51 is rotated by 90 degrees in the counterclockwise direction, the first surface 64 faces the first frame 51. In other words, the posture of the second frame 52 with respect to the first frame 51 is switched to the first posture. When the second frame 52 that is disposed perpendicularly with respect to the first frame 51 is rotated by 90 degrees in the clockwise direction, the second surface 65 faces the first frame 51. In other words, the posture of the second frame 52 with respect to the first frame 51 is switched to the second posture.

When the position of the second frame 52 with respect to the first frame 51 is the first position, the first distance L1 between the support portion 81 of the support member 75 and the first frame 51 is shorter than a second distance L2 between the rotation portion 83 of the support member 75 and the first frame 51. When the position of the second frame 52 with respect to the first frame 51 is the first position, the lock mechanism 53 of the present embodiment can press the second frame 52 to the first frame 51. When causing the sewing object C to be held by the embroidery frame 5, the user sets the position of the second frame 52 with respect to the first frame 51 to the first position to switch the pressure that is applied to the second frame 52 from the pressing lever 79 toward the first frame 51 to one of the first pressure, the second pressure, and the third pressure, in accordance with the thickness of the sewing object C. In this way, the sewing object C is pressed to the first frame 51 side by the second frame 52, and the possibility of displacement of the sewing object C with respect to the embroidery frame 5 during sewing is reduced. When the position of the second frame 52 with respect to the first frame 51 is the second position or the third position, the first distance L1 between the support portion 81 of the support member 75 and the first frame 51 is longer than the second distance L2 between the rotation portion 83 of the support member 75 and the first frame 51. When the position of the second frame 52 with respect to the first frame 51 is the second position or the third position, the lock mechanism 53 of the present embodiment does not press the second frame 52 to the first frame 51 side. When performing the operation causing the sewing object C to be held by the embroidery frame 5, or the operation to remove the sewing object C from the embroidery frame 5, the user presses the lock release lever 77 downward and, in accordance with the thickness of the sewing object C, operating conditions and the like, sets the position of the second frame 52 with respect to the first frame 51 to the second position or the third position.

The embroidery frame 5 of the above-described embodiment is configured to rotate the posture of the second frame 52 to the first posture and the second posture. When removing dirt that has attached to the first surface 64 of the second frame 52, the user can easily perform an operation to remove the dirt by setting the posture of the second frame 52 with respect to the first frame 51 to the second posture. The embroidery frame 5 can improve maintainability in comparison to known art.

In the second frame 52, the first surface 64 has the first anti-slip portion 66, and the second surface 65 has the second anti-slip portion 67. The lock mechanism 53 is configured to press the second frame 52 to the first frame 51 side in each of the first posture and the second posture. The embroidery frame 5 can press and clamp the sewing object C in each of the first posture and the second posture. Even when the sewing object C is held in one of the first posture and the second posture, the embroidery frame 5 can suppress the sewing object C from moving with respect to the second frame 52. The lock mechanism 53 of the embroidery frame 5 can avoid the occurrence of a defect resulting from a case in which the second frame 52 cannot be pressed in the second posture. The defect is, for example, deformation of or damage to the second frame 52 as a result of the user mistakenly pressing the second frame 52 in the second posture even though the second frame 52 in the second posture cannot be pressed.

The first anti-slip portion 66 and the second anti-slip portion 67 have mutually different physical properties. The embroidery frame 5 can switch the posture of the second frame 52 with respect to the first frame 51 between the first posture and the second posture in accordance with the material and the thickness of the sewing object C, and the like. In other words, by selecting the anti-slip portion suited to the material and the thickness of the sewing object C, and the like, from the first anti-slip portion 66 and the second anti-slip portion 67, the embroidery frame 5 can reliably clamp the sewing object C in a taut state. The embroidery frame 5 can suppress the embroidery pattern from becoming displaced from a position at which sewing is intended as a result of slackening of the sewing object C during embroidery sewing. The first anti-slip portion 66 is the pile member having the short fibers that extend in an inclined manner from the inside to the outside of the second frame 52. In this case, a tension force acts on the sewing object C in a direction from the inside to the outside of the second frame 52 at the first surface 64 of the second frame 52, and the embroidery frame 5 can reliably clamp the sewing object C in the taut state. The embroidery frame 5 can suppress the embroidery pattern from becoming displaced from the position at which sewing is intended as a result of the slackening of the sewing object C during embroidery sewing.

The support member 75 includes the support portion 81 that supports the second frame 52 on the one end side, and the rotation portion 83 that is rotatably supported with respect to the first frame 51 on the other end side. The second frame 52 is rotatable with respect to the first frame 51, around the rotation portion 83, at a position at which the first distance L1 between the support portion 81 and the first frame 51 becomes half or more of the length L3 of the side, among the sides of the second frame 52, that is supported by the support portion 81. According to the embroidery frame 5, the user can easily switch to the first posture and the second posture.

The embroidery frame 5 can switch the position of the second frame 52 with respect to the first frame 51 to one of the three or more positions including the first position, the second position, and the third position, and can hold the second frame 52 in each of the first position and the second position. By switching the position of the second frame 52 with respect to the first frame 51 to one of the three or more positions including the first position, the second position, and the third position, the user can cause the sewing object C to be held appropriately by the embroidery frame 5, in accordance with the thickness of the sewing object C, the operation conditions, and the like. In comparison to an embroidery frame of known art, with the embroidery frame 5, the user can easily perform the operation causing the sewing object C to be held in the embroidery frame 5.

The lock mechanism 53 of the embroidery frame 5 includes the first lock mechanism 71 and the second lock mechanism 72. The embroidery frame 5 is configured to separately switch the position of the second frame 52 with respect to the first frame 51 on the one side and on the other side of the second frame 52, and is configured to hold the second frame 52. Even when the lock release lever 77 of one of the first lock mechanism 71 and the second lock mechanism 72 is operated unintentionally, as long as the other lock release lever 77 is not operated, the second frame 52 does not open completely with respect to the first frame 51. In comparison to the embroidery frame of known art, with the embroidery frame 5, the user can easily perform the operation causing the sewing object C to be held in the embroidery frame 5. The first lock mechanism 71 and the second lock mechanism 72 are symmetrical with each other with respect to the central line M1 in the left-right direction of the embroidery frame 5. Thus, some of the members (the support member 75 and the lock release lever 77, for example) can be commonalized.

With the embroidery frame 5, the concave portion 96 with which the end portion of the lock release lever 77 engages is switched in accordance with the operation of one of the pressing lever 79 and the lock release lever 77, and the position of the second frame 52 with respect to the first frame 51 is thus switched and the second frame 52 is held. By the simple operation of the user appropriately operating the pressing lever 79 and the lock release lever 77 and switching the concave portion 96 with which the recessed portion 87 of the lock release lever 77 is engaged, the position of the second frame 52 with respect to the first frame 51 can be switched and the second frame 52 can be held. The lock release lever 77 is provided on the rear end portion of the embroidery frame 5, and, when the embroidery frame 5 is mounted on the sewing machine 1, the lock release lever 77 is in a position not easily operated by the user. Thus, the embroidery frame 5 can reduce the possibility of the user unintentionally operating the lock release lever 77.

The support member 75 is formed by bending the bar-shaped elastic body. According to the embroidery frame 5, when the second frame 52 is disposed in the closed position with respect to the first frame 51 and the pressing portion 92 of the pressing lever 79 is pressing the support member 75, the support member 75 can appropriately release the pressure applied from the pressing portion 92 as a result of elastic deformation of the support member 75. The embroidery frame 5 can avoid irreversible deformation of or damage to the support member 75 as a result of the pressing of the support member 75 by the pressing portion 92.

The support member 75 of the embroidery frame 5 includes the bent portion 82. When the position of the second frame 52 with respect to the first frame 51 is the first position, the pressing portion 92 presses the bent portion 82 of the support member 75 to the first frame 51 side. According to the embroidery frame 5, in comparison to a case in which the pressing portion 92 of the embroidery frame 5 presses a location that is not the bent portion 82 (the front portion 84, for example) of the support member 75, the pressing portion 92 can reliably press the second frame 52 to the first frame 51 side via the support member 75.

The pressing lever 79 of the embroidery frame 5 is provided with the plurality of convex portions 97 that are adjacent to the concave portions 96, that protrude to the side away from the rotation portion 83, and that are provided in the number corresponding to the plurality of concave portions 96. From among the plurality of convex portions 97, the convex portion in the position furthest away from the first frame 51 is the largest convex portion 98. The largest convex portion 98 has the largest protrusion amount with respect to the rotation portion 83, among the plurality of convex portions 97. From among the three or more positions of the second frame 52 with respect to the first frame 51, in the position at which the distance between the first frame 51 and the support portion 81 is largest, the largest convex portion 98 is passed, and the position at which the distance between the first frame 51 and the support portion 81 is largest corresponds to the position in which the engagement between the pressing lever 79 and the lock release lever 77 is released. The embroidery frame can avoid unintentionally obtaining the state in which the largest convex portion 98 is passed, the engagement between the pressing lever 79 and the lock release lever 77 is released, and an opening degree of the second frame 52 with respect to the first frame 51 is at a maximum.

In the embroidery frame 5, when the position of the second frame 52 with respect to the first frame 51 is the first position, the first distance L1 is shorter than the second distance L2. In each of the second position and the third position, the first distance L1 is longer than the second distance L2. In the embroidery frame 5, in the two positions of the second position and the third position, the user can perform the operations to arrange the sewing object C with respect to the embroidery frame 5 or to remove the sewing object C from the embroidery frame 5. The user can select whether to set the position of the second frame 52 with respect to the first frame 51 to be the second position or the third position, in accordance with the thickness of the sewing object C, the operating conditions, and the like.

When the position of the second frame 52 with respect to the first frame 51 is the first position, the lock mechanism 53 is configured to switch the position of the pressing lever 79 with respect to the lock release lever 77 to the first pressing position, the second pressing position, and the third pressing position, and hold the second frame 52. By appropriately setting the position of the pressing lever 79 with respect to the lock release lever 77 from among the first pressing position, the second pressing position, and the third pressing position, the embroidery frame 5 can adjust the pressure applied to the sewing object C clamped between the first frame 51 and the second frame 52. The embroidery frame 5 can separately switch the closed position of the second frame 52 with respect to the first frame 51 in a multiple of stages (three stages in the present embodiment) on the one side and on the other side of the second frame 52. The support portion 81 is inserted into the hole 63 provided in substantially the center of the length of the second frame 52 in the front-rear direction. Thus, the lock mechanism 53 (the support member 75) can cause the force toward the first frame 51 to be applied at substantially the center of the second frame 52 in the front-rear direction.

The embroidery frame unit 30 is provided with the frame attachment member 31 that is removably fixed to the holder 25 of the movement mechanism 20 of the sewing machine 1. When the embroidery frame 5 is held by the attachment portion 32 of the frame attachment member 31 and the lock release lever 77 is operated to the first frame 51 side in the state in which the second frame 52 is in the first position with respect to the first frame 51, the lock release lever 77 approaches the frame support portion 37 of the frame attachment member 31. When the lock release lever 77 is further operated to the first frame 51 side, the lock release lever 77 comes into contact with the frame support portion 37 before the third position, at which the distance between the first frame 51 and the support portion 81 is greatest, is reached, and the second frame 52 is thus restricted from entering the third position with respect to the first frame 51. According to the embroidery frame unit 30, the user can switch the position of the second frame 52 with respect to the first frame 51 to one of the three or more positions including the first position, the second position, and the third position, in accordance with the thickness of the sewing object C, the operating conditions, and the like, and then the user can use the first frame 51 and the second frame 52. In the state in which the embroidery frame 5 is attached to the frame attachment member 31, the embroidery frame unit 30 can reliably inhibit the position of the second frame 52 with respect to the first frame 51 from becoming the third position at which the distance between the first frame 51 and the support portion 81 is greatest. In the state in which the embroidery frame 5 of the present embodiment is attached to the sewing machine 1, in terms of spatial relationships, the position of the second frame 52 with respect to the first frame 51 cannot be set to the third position. In the state in which the embroidery frame 5 is attached to the sewing machine 1, the embroidery frame 5 can reliably inhibit the position of the second frame 52 with respect to the first frame 51 from moving from the second position toward the third position.

When the embroidery frame unit 30 is mounted on the sewing machine 1 and the position of the second frame 52 with respect to the first frame 51 is the second position, the second frame 52 is disposed between the presser foot 24 that is in the raised position and the needle plate 27, in a direction perpendicular to the needle plate 27 (the up-down direction). According to the sewing machine 1, the user can switch the position of the second frame 52 with respect to the first frame 51 to one of the three or more positions including the first position, the second position, and the third position, in accordance with the thickness of the sewing object C, the operating conditions, and the like, and then use the first frame 51 and the second frame 52. In the sewing machine 1, even when the position of the second frame 52 with respect to the first frame 51 is the second position, the second frame 52 does not come into contact with the presser foot 24 that is in the raised position. By setting the position of the second frame 52 with respect to the first frame 51 to the second position, the user can perform the operations to remove the sewing object C held by the embroidery frame 5, to arrange the sewing object C to be held by the embroidery frame 5 on the first frame 51, and the like, without removing the embroidery frame 5 from the sewing machine 1.

The sewing machine, the embroidery frame unit, and the embroidery frame of the present disclosure are not limited to the above-described embodiment, and various modifications may be made without departing from the broad spirit and scope of the present disclosure. For example, the following modifications (A) to (C) may be added as appropriate.

(A) The configurations of the embroidery frame 5, the embroidery frame unit 30, and the sewing machine 1 may be modified as appropriate. The number of the needle bars provided in the sewing machine 1 may be one or more. The sewing machine 1 may be configured such that one or more types of embroidery frame can be mounted thereon. The embroidery frame 5 may be configured to be directly mounted on the holder 25 of the sewing machine 1. When the embroidery frame 5 is configured to be directly mounted on the holder 25 of the sewing machine 1, the embroidery frame 5 may be configured in the following manner. Specifically, when the lock release lever 77 is operated in a state in which the second frame 52 of the embroidery frame 5 attached to the sewing machine 1 is in the second position, the movement of the lock release lever 77 toward the first frame 51 may be restricted by coming into contact with the holder 25. When the embroidery frame 5 is attached to the sewing machine 1 via the frame attachment member 31, the configuration of the frame attachment member 31 may be changed as appropriate.

(B) A size, a plan view shape, a thickness and the like of the embroidery frame 5 may be changed as appropriate. The embroidery frame 5 may be able to switch the position of the second frame 52 with respect to the first frame 51 to three or more positions, and may be able to hold the second frame 52 in at least the first position and the second position. Each of the first predetermined amount, and the second predetermined amount may be changed as appropriate. In the first position, the distance between the first frame 51 and the second frame 52 need not necessarily be zero. In the embroidery frame 5, the position at which the sewing object C is held may be one of the first position and the second position, and the position at which the operation to arrange and hold the sewing object C and so on can be performed may be the third position. The embroidery frame 5 need not necessarily switch the posture of the second frame 52 with respect to the first frame 51 between the first posture and the second posture.

(C) The lock mechanism 53 need not necessarily be provided with the first lock mechanism 71 and the second lock mechanism 72. The first lock mechanism 71 and the second lock mechanism 72 need not necessarily be configured to be symmetrical. The first lock mechanism 71 and the second lock mechanism 72 need not necessarily be able to separately set the position of the second frame 52 with respect to the first frame 51. The configuration of each of the members provided in the lock mechanism 53 may be changed as appropriate. For example, the configuration of each of the members provided in the lock mechanism 53 may be changed as described below.

(C-1) A rotation shaft that rotatably supports the pressing lever 79 may be provided as a separate body to the support member 75. The support member 75 may be formed of a material other than the elastic body (a metal plate body, for example). The support member 75 need not necessarily be provided with the bent portion 82. When the support member 75 is not provided with the bent portion 82, the pressing lever 79 may be configured to be able to press at least one of the front portion 84 and the support portion 81 to the first frame 51 side. The first energizing member 78 and the second energizing member 80 may be another member, such as a plate spring or the like.

(C-2) The numbers and shapes of the concave portions 96 and the convex portions 97 provided on the engagement portion 94 of the pressing lever 79 may be changed as appropriate in accordance with the position of the second frame 52 with respect to the first frame 51. Of the plurality of convex portions 97, the convex portion in the position furthest away from the first frame 51 need not necessarily be the largest convex portion that protrudes most with respect to the rotation shaft 76.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame comprising:

a pair of a first frame and a second frame configured to clamp a sewing object; and a lock mechanism including a first lock mechanism and a second lock mechanism, the first lock mechanism rotatably supporting the second frame on one side of the second frame, the first lock mechanism being configured to switch the position of the second frame with respect to the first frame to each one of at least three positions including a first position, a second position and a third position, the first position being a position in which the second frame is closed with respect to the first frame, the second position being a position in which, with respect to the first frame, the second frame is more open, by a first predetermined amount, than in the first position, and the third position being a position in which, with respect to the first frame, the second frame is open by a second predetermined amount, the second predetermined amount being larger than the first predetermined amount, the first lock mechanism being configured to hold the second frame in at least each of the first position and the second position, and the second lock mechanism rotatably supporting the second frame on an opposite side to the one side of the second frame, and, the second lock mechanism being configured to switch the position of the second frame with respect to the first frame to each one of the at least three positions separately from the first lock mechanism, and the second lock mechanism being configured to hold the second frame in at least each of the first position and the second position.

2. The embroidery frame according to claim 1, wherein the lock mechanism includes a support member, a first rotation shaft, a lock release lever, a first energizing member, a second rotation shaft, a pressing lever, and a second energizing member, the support member including a support portion and a rotation portion, the support portion supporting the second frame on one end side of the support member, the rotation portion being rotatably supported with respect to the first frame at another end side of the support member, the lock release lever being rotatably supported with respect to the first frame by the first rotation shaft on the one end side and extending from the first rotation shaft to the other end side, the first energizing member energizing the lock release lever in a first rotation direction away from the first frame, the pressing lever being rotatably supported with respect to the first frame around the second rotation shaft, the pressing lever being provided with a plurality of concave portions and a pressing portion, each of the plurality of concave portions being recessed to the second rotation shaft, the each of the plurality of the concave portions being configured to engage with an end portion on the one end side of the lock release lever, the pressing portion being configured to pressing the support member to the first frame side with respect to the second frame, and the second energizing member energizing the pressing lever to the side away from the first frame, and the lock mechanism is configured to switch the position of the second frame with respect to the first frame by switching the concave portion engaged with the end portion of the lock release lever in accordance with an operation of one of the pressing lever and the lock release lever, and is configured to hold the second frame in each of the at least three positions.

3. The embroidery frame according to claim 2, wherein the support member is formed of an elastic body.

4. The embroidery frame according to claim 2, wherein the support member includes a bent portion bent in a U shape in an extending direction of the second rotation shaft, and the pressing portion is configured to press the bent portion of the support member to the first frame side with respect to the second frame.

5. The embroidery frame according to claim 2, wherein the pressing lever is provided with a number of convex portions corresponding to the plurality of concave portions, the convex portions being adjacent to the concave portions and protruding to the side away from the second rotation shaft, from among the plurality of convex portions, a largest convex portion provided at a furthest position from the first frame has a largest protrusion amount with respect to the second rotation shaft, and from among the plurality of positions of the second frame with respect to the first frame, the third position in which a distance between the first frame and the support portion is largest, corresponds to a position at which the lock release lever has passed beyond the largest convex portion and the engagement between the pressing lever and the lock release lever is released.

6. The embroidery frame according to claim 2, wherein in the first position, a first distance between the support portion of the support member and the first frame is shorter than a second distance between the rotation portion of the support member and the first frame, and in the second position, the first distance is longer than the second distance.

7. The embroidery frame according to claim 2, wherein when the position of the second frame with respect to the first frame is the first position, the lock mechanism is configured to switch the position of the pressing lever with respect to the lock release lever to a first pressing position and a second pressing position, the first pressing position being a position in which a first pressure is applied to the second frame toward the first frame side with respect to the second frame, and the second pressing position being a position in which a second pressure is applied to the second frame toward the first frame side with respect to the second frame, the second pressure being larger than the first pressure.

8. The embroidery frame according to claim 1, wherein the lock mechanism includes a support member, a lock release lever, a rotation shaft, a pressing lever, and an energizing member, the support member supporting the second frame on one end side and being rotatably supported with respect to the first frame on another end side, the lock release lever being supported by the first frame, the pressing lever being rotatably supported with respect to the first frame around the rotation shaft and pressing the support member to the first frame side with respect to the second frame, the pressing lever being provided with a plurality of concave portions, each of the plurality of concave portions being recessed toward the rotation shaft, the each of the plurality of concave portions being configured to engage with an end portion on the one end side of the lock release lever, the energizing member energizing the pressing lever to the side away from the first frame, the lock mechanism is configured to switch the position of the second frame with respect to the first frame by switching the concave portion engaged with the lock release lever in accordance with an operation of the pressing lever, and the lock mechanism is configured to hold the second frame in each of the at least three positions.

9. An embroidery frame unit comprising:

a frame attachment member including an attachment portion and a frame support portion removably fixed to a holder of a movement mechanism of a sewing machine; and an embroidery frame including a pair of a first frame and a second frame, and a lock mechanism, and the embroidery frame being removably held by the attachment portion, the pair of the first frame and the second frame being configured to clamp a sewing object, the lock mechanism being configured to switch a position of the second frame with respect to the first frame to at least three positions including a first position, a second position, and third position, the first position being a position in which the second frame is closed with respect to the first frame, the second position being a position in which, with respect to the first frame, the second frame is more open, by a first predetermined amount, than in the first position, the third position being a position in which, with respect to the first frame, the second frame is open by a second predetermined amount, the second predetermined amount being larger than the first predetermined amount, the lock mechanism including a support member, a first rotation shaft, a lock release lever, a first energizing member, a second rotation shaft, a pressing lever, and a second energizing member, the support member including a support portion and a rotation portion, the support portion supporting the second frame on one end side of the support member, the rotation portion being rotatably supported with respect to the first frame at another end side of the support member, the lock release lever being rotatably supported with respect to the first frame by the first rotation shaft on the one end side and extending from the first rotation shaft to the other end side, the first energizing member energizing the lock release lever in a first rotation direction away from the first frame, the pressing lever being rotatably supported with respect to the first frame around the second rotation shaft, the pressing lever being provided with a plurality of concave portions and a pressing portion, each of the plurality of concave portions being recessed toward the second rotation shaft, the each of the plurality of concave portions being configured to engage with an end portion on the one end side of the lock release lever, the pressing portion being configured to press the support member to the first frame side with respect to the second frame, the second energizing member energizing the pressing lever to the side away from the first frame, the lock mechanism being configured to switch the position of the second frame with respect to the first frame by switching the concave portion engaged with the end portion of the lock release lever in accordance with an operation of one of the pressing lever and the lock release lever, and the lock mechanism being configured to hold the second frame in each of the at least three positions, the lock release lever being configured to approach the frame support portion of the frame attachment member when the position of the second frame with respect to the first frame is the first position, the lock release lever being configured to come into contact with the frame support portion before the third position is reached to restrict the second frame from entering the third position with respect to the first frame, when the lock release lever is further operated to the first frame side with respect to the second frame, the third position being a position at which the distance between the first frame and the support portion is greatest.

10. A sewing machine comprising:

a needle bar on which a sewing needle is mountable;

a presser foot;

a needle plate including a needle hole through which the sewing needle is passable;

a movement mechanism including a holder and configured to move the holder; and an embroidery frame including a pair of a first frame and a second frame, and a lock mechanism, the embroidery frame being removably attached to the holder, the pair of the first frame and the second frame being configured to clamp a sewing object, the lock mechanism including a first lock mechanism and a second lock mechanism, the first lock mechanism rotatably supporting the second frame on one side of the second frame, the first lock mechanism being configured to switch the position of the second frame with respect to the first frame to each one of at least three positions including a first position, a second position, and a third position and being configured to hold the second frame, the first position being a position in which the second frame is closed with respect to the first frame, the second position being a position in which, with respect to the first frame, the second frame is more open, by a first predetermined amount, than in the first position, the third position being a position in which, with respect to the first frame, the second frame is open by a second predetermined amount, the second predetermined amount being larger than the first predetermined amount, and the second frame being positioned between the presser foot and the needle plate in a direction perpendicular to the needle plate under a condition in which the embroidery frame is attached to the holder and the position of the second frame with respect to the first frame is the second position, the first lock mechanism being configured to hold the second frame in at least each of the first position and the second position, and the second lock mechanism rotatably supporting the second frame on an opposite side to the one side of the second frame, and, the second lock mechanism being configured to switch the position of the second frame with respect to the first frame to each one of the at least three positions separately from the first lock mechanism, and the second lock mechanism being configured to hold the second frame in at least each of the first position and the second position.

* * * * *